United States Patent [19]

Smith

[11] Patent Number: 5,022,781

[45] Date of Patent: Jun. 11, 1991

[54] ANTI-GLARE MODULES ADAPTABLE TO HIGHWAY MEDIAN BARRIERS

[76] Inventor: Timothy S. Smith, 2121 N. Arnoult Dr., Metairie, La. 70001

[21] Appl. No.: 452,577

[22] Filed: Dec. 18, 1989

[51] Int. Cl.[5] ..... E01F 15/00

[52] U.S. Cl. ..... 404/6; 404/34; 404/35; 256/13.1; 256/73; 52/64; 52/262; 181/210; 181/284

[58] Field of Search ..... 404/1, 73, 99, 6–12, 404/34–37; 256/1, 13.1, 73, 13.1, 73; 40/608; 181/210, 284; 52/64, 71, 144, 250, 174, 295

[56] References Cited

U.S. PATENT DOCUMENTS 4,338,041 7/1982 Schmanski ..... 404/9

*Primary Examiner*—Ramon S. Britts
*Assistant Examiner*—Roger J. Schoeppel
*Attorney, Agent, or Firm*—Pravel, Gambrell, Hewitt, Kimball & Krieger

[57] ABSTRACT

What is provided is a system which would utilize a plurality of glare modules, constructed of a lightweight foam material, and that could be positioned spaced apart end to end, along the length of the highway median barrier. Each of the modules would be secured to the barrier by a pair of mounting rods firmly secured to the upper face of the barrier and slideably engagable into a pair of openings in the bottom of the barrier module. The barrier panel would then be secured to the mounting rods with a locking pin.

9 Claims, 3 Drawing Sheets

ANTI-GLARE MODULES ADAPTABLE TO HIGHWAY MEDIAN BARRIERS

BACKGROUND OF THE INVENTION

1. Field of the Invention

The system of the present invention relates to barriers on highways to prevent glare from oncoming vehicles. More particularly the present invention which provides for a plurality of modules which are positionable atop a highway median barrier, constructed of lightweight material, and insertable and removable in an easy and efficient manner.

2. General Background

In the construction of modern highways, it is often a requirement for federal highway construction that there be incorporated into the construction a system for reducing or eliminating glare of the oncoming traffic during nighttime driving when the opposing lane of traffic must necessarily run adjacent one another. There have been many crude attempts to eliminate such glare, such as the construction of fences between the lanes of traffic, or any type of a barrier which would help solve the problem. There is presently in the art, a glare foil assembly unit which is a patented system under U.S. Pat. No. 4,338,041 which provides for a plurality of glare panels in an assembly, wherein the blades are attached to a continuous base section with the base rigidly mounted to the top of the median barrier at opposing ends. This system is widely utilized, but does not address some of the ongoing problems. For example, in the event the attachment base is in any way damaged by automobiles or the like, it is foreseen that large portions of the assembly would have to be replaced in order to properly repair the system. This would require time and expense and would be quite inefficient. Therefore, there is a need to provide a more efficient system of erecting of a glare panel assembly on the median barrier of the highway which would eliminate the increased costs of replacement parts.

SUMMARY OF THE PRESENT INVENTION

The system of the present invention eliminates the problems in a simple and straightforward manner. In the preferred embodiment, what is provided is a system which would utilize a plurality of glare modules, constructed of a lightweight foam material, and that could be positioned spaced apart end to end, along the length of the highway median barrier. Each of the modules would be secured to the barrier by a pair of mounting rods firmly secured to the upper face of the barrier and slideably engagable into a pair of openings in the bottom of the barrier module. The barrier module would then be secured to the mounting rods with a locking pin. In a second embodiment, there would be provided an independently mounted blade, each of the blades mounted intermediate a pair of of L-shaped brackets, with the foot of the brackets mounted securely into the upper face of the highway barrier median. The blades would be positioned angularly, to provide a substantially continuous surface or obstruction surface or anti-glare surface in relation to the paths of the oncoming vehicles along the side of the barriers.

Therefore, the principal object of the present invention is to provide an anti-glare barrier system for highways which would be constructed in independent sections, so that any damage to one or several sections would require only the replacement of that particular section;

It is a further object of the present invention to provide a system with anti-glare modules, so that the panels can be constructed of a lightweight material and easily positionable atop a median barrier, and secured thereto when in use;

It is still a further object of the present invention to provide a system of anti-glare modules, which could be securely attached atop a median barrier, but easily replaced in the event that the modules were damaged while in use;

It is still a further object of the present invention to provide a system of anti-glare modules which are secured atop a medium barrier of a highway, and positioned in a continuous manner in order to impede a pedestrian from attempting to cross the highway and thus creating a dangerous traffic situation;

It is still a further object of the present invention to provide a system of anti-glare modules which are easily removable in the event an emergency unit has to have access to a portion of highway that is on the other side of the module from the emergency unit.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
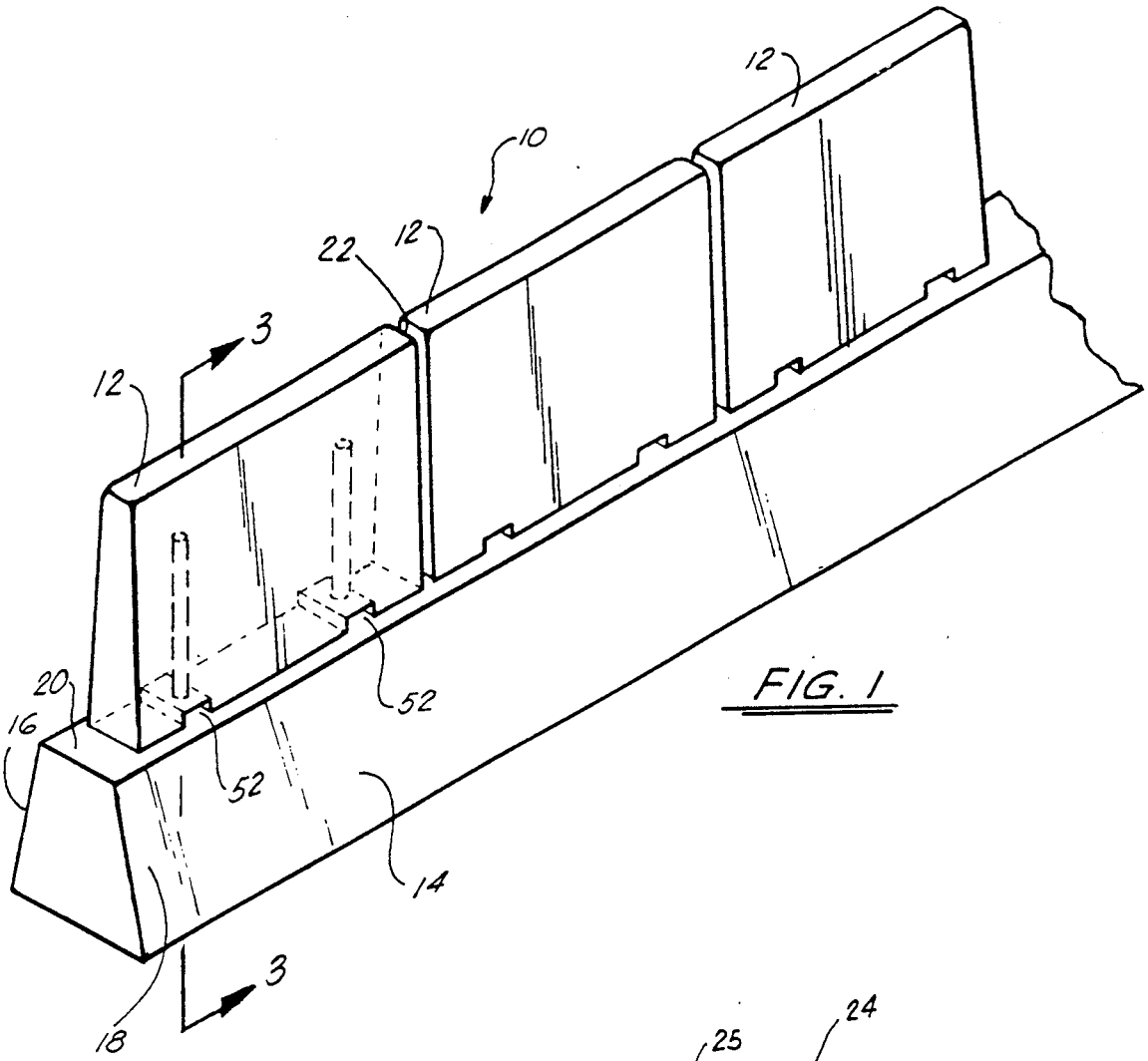
FIG. 1 illustrates an overall view of the preferred embodiment of the system of the present invention mounted upon a highway median barrier.

FIGS. 1–4 illustrate the preferred embodiment of the apparatus of the present invention by the numeral 10. As illustrated in FIGS. 1–4 apparatus 10 would comprise a plurality of modules 12 positioned along a top a highway barrier or median barrier 14, of the type having a pair of telescoping sidewalls 16, 18, and a truncated, flat, top portion 20, upon which the barrier modules 12 are mounted. As further illustrated in FIG. 1, in the preferred embodiment, each of the modules 12 would be spaced apart a particular distance 22 between the modules, so as to allow the movement of air therethrough, yet substantially define a continuous median barrier system.

Turning now to the manner in which the modules are constructed and assembled, reference is made to FIGS.

Figure 2:
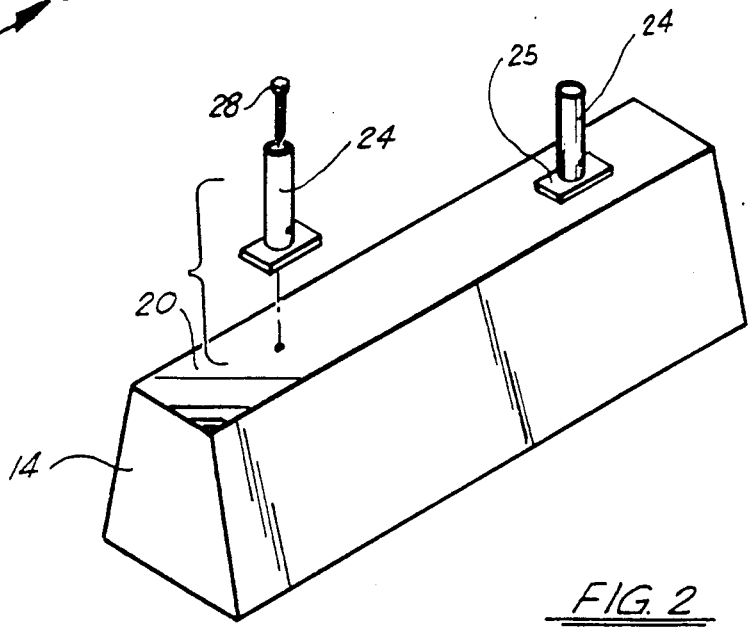
FIG. 2 illustrates a median barrier with a portion of the preferred embodiment of the apparatus being mounted thereonto.
Figure 5:
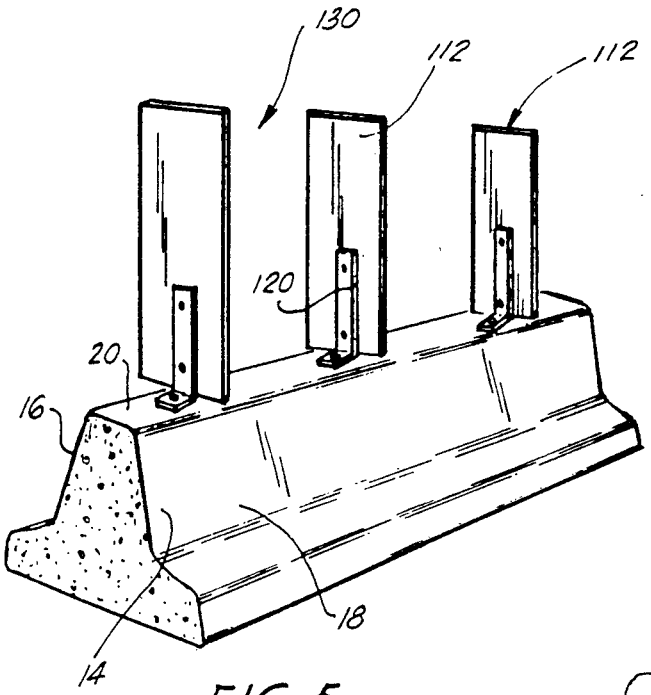
FIG. 5 illustrates an overall view of a second embodiment of the system of the present invention.
Figure 3:
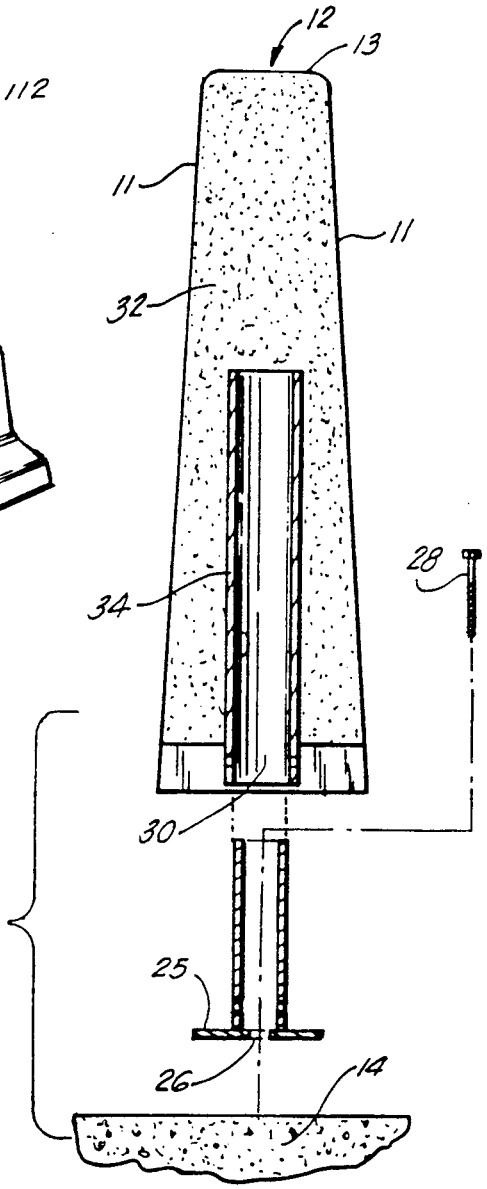
FIG. 3 illustrates a cross-section view along lines 3—3 in FIG. 1 of the preferred embodiment of the system of the present invention.
Figure 4:
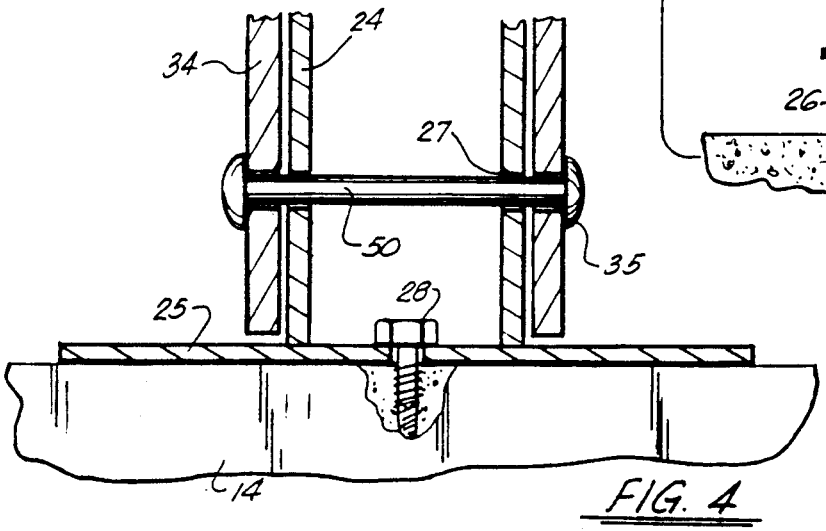
FIG. 4 illustrates a detailed cross-section view of the mounting of the glare modules in the preferred embodiment of the system of the present invention.
Figure 6:
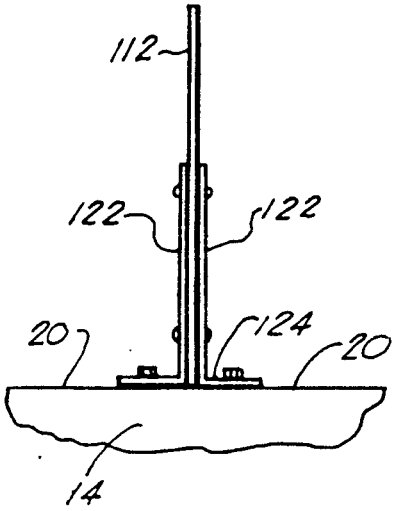
FIGURE 6 illustrates a side view of the second embodiment of the present invention.

2-4. As illustrated in FIG. 2, in order to provide proper mounting of the modules, there is provided a pair of mounting rods 24 which are securely engaged and positioned onto the top 20 of the barrier 14. The rods 24 would include a base portion 25 which would rest atop the top portion 20 at barrier 14 and as illustrated in FIG. 3, base portion 25 would include a bore 26 through the base, for accommodating a screw 28 of the type that could be screwed into the concrete barrier 14 in order to secure the base in position as seen in FIG. 4. Following the position of each pair of mounting rods 24 would correspond to the spacing of the means contained in each of the modules 12 for mounting the modules 12 onto the median barrier.

As seen in FIG. 3, this means would include a substantially circular opening 30 bored within the body of the barrier. The body portion 32 of barrier 12 to a length so as to accommodate the full length of mounting rod 24 when mounting rod 24 would be inserted thereinto. The bore 30 would be lined with a cylinder 34, cylinder 34 having an inner diameter slightly larger than outer diameter of mounting rod 24, so as to slidingly accommodate mounting rod 24 within the opening 30 as illustrated in FIG. 4. Therefore, after mounting rods 24 have been secured in position via screw members 28, a module member 12 could simply be slideably positioned onto rods 24 as illustrated in FIG. 1, with the barrier supported thereupon by the rod 24 extending into opening 30.

In order to provide a permanent positioning of module 12 onto rods 24, there is provided a means to lockingly engage module 12 onto rods 24. This means is illustrated in FIG. 4, and comprises a bore 35 in the sidewall of cylinder 34 which is at a height of a bore 27 in the sidewall of pin 24, a height above base 25 which would correspond to the bore 35 in the sidewall of tube 34, so that a locking pin 50 may be inserted through the corresponding bores and lockingly engage the module 12 onto the mounting pins 24. In order to have access to the mounting pins 50 in both the placement of the mounting pins and the removal of the mounting pins, each of the glare modules are provided with an indexed portion 52 at the corresponding position of each pin 50, so that one may have access to the pin 50 during its insertion and removal when the glare modules are being placed in position.

For purposes of construction, it should be noted that each of the glare modules 12 are constructed of a lightweight foam material, and have a pair of telescoping sidewalls 11, and a truncated top portion 13 which would allow the modules to be constructed by simply being poured into a mold and allowed to harden and remove from the mold so that the tube 34 may be inserted into port 30, and the glare modules may then be positioned onto the barrier quite easily due to their lightweight character. The modules may be coated with some type of exterior coating in order to provide that the modules are weather proof and would be able to resist the elements.

A second embodiment of the apparatus is illustrated in FIGS. 5-8 which again would include a highway barrier 14 having again sidewalls 16, 18, and a truncated top 20. In this particular embodiment, a plurality of glare panels 112 would be utilized which are constructed of a type of rubberized flexible material, which would be substantially ¼ to ½ inch in thickness, and would be rectangular in shape having a pair of elongated sidewalls 113 and 115 and a flat portion 116 which would rest against the top 20 of barrier 14 as illustrated. In order to maintain each of the plates 112 in position there would be provided pair of T-brackets 120 each of the L-brackets 120 positioned on both faces 117 of the panels 112, with each of the L-brackets having an upward extending mounting portion 122, and a base portion 124, with the base 124 secured to the upper face 20 of barrier 14 via a mounting screw 126, and with the support portions 122 engaging the panel 112 therebetween and held in position via pair of pin members 128.

Figure 8:
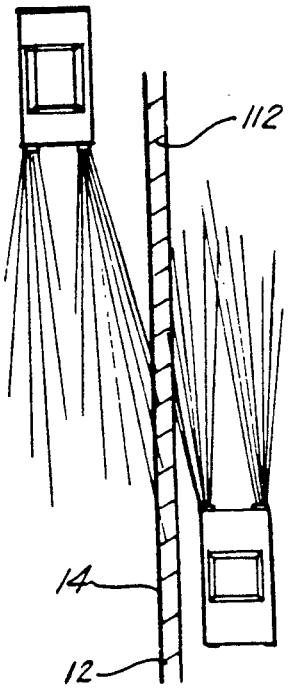
FIG. 8 illustrates a top view of the second embodiment of the system in position on a highway median.
Figure 7:
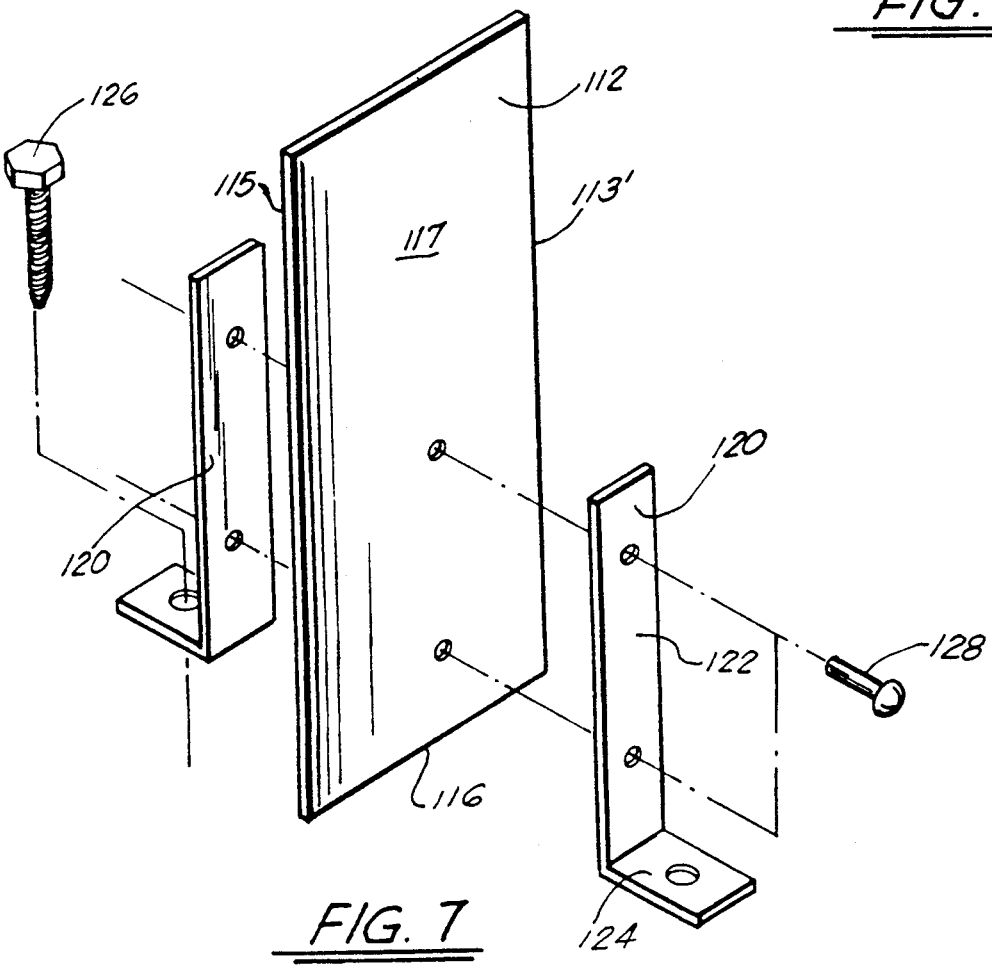
FIG. 7 illustrates a partial exploded view of the second embodiment of the present invention.

As illustrated in side view, therefore each of the panels 112 would be held upright via the pair of L-brackets 120 as they are secured to the upper face 20 of barrier 14 at their base portion 124. In the proper use of this embodiment, it should be noted that the panels would necessarily be positioned at a angle less than ninety degrees (90°) of the sidewall 16, 18 of the median, so that the panels may be spaced apart a certain distance 130, and yet still serve as a continuous barrier between cars traveling on the highway. This is illustrated in FIG. 8, where the median 14 is illustrated with the plurality of glare panels 112 spaced apart and yet still serving as a continuous barrier between the automobiles due to the relationship between the angular configuration of each of the glare panels 112 and the position of the automobiles as automobiles are traveling along the highway with the glare panels positioned to eliminate glare between the oncoming traffic.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as the invention is:

1. An anti-glare, module mountable to the median barrier of a divided highway, comprising:

a) a principal body portion, constructed of lightweight material, and including a first and second bores in the base of the anti-glare module;

b) first and second mounting rods secured to the median barrier, each of the mounting rods positioned a distance apart for slideably engaging into the first and second bores of each anti-glare module;

c) means for securing the anti-glare module onto the mounting rods, so that the bottom face of the anti-glare module is positioned adjacent the upper face of the barrier, and the anti-glare module is secured onto each of the mounting rods.

2. The anti-glare module in claim 1, wherein the anti-glare module is constructed of a lightweight foam or plastic material.

3. The anti-glare module in claim 1, wherein each of the first and second bores further include a metal sleeve inserted into the bores.

4. The anti-glare module in claim 1, wherein the mounting rods are secured to the anti-glare module via mounting pins at the base of each of the mounting rods.

5. The anti-glare module in claim 1, wherein a plurality of anti-glare modules further comprise a substantially continuous median barrier between the divided highway.

6. A system of anti-glare modules positionable upon a median barrier of a divided highway, the system comprising:

a) first and second mounting rods positionable onto the upper surface of a section of median barrier spaced a predetermined distance apart;

b) an anti-glare module body, of sufficient thickness to accommodate a pair of bores in the underside of the body of sufficient length to accommodate the mounting rods within the bores, as the bottom face of the anti-glare module rests upon the upper face of the median barrier;

c) tubular members positioned within the bore of the anti-glare module, for lockingly engaging the mounting rods, after the anti-glare module has been positioned onto the barrier; and d) at least a second anti-glare module positioned adjacent the first anti-glare module, and spaced apart therefrom for defining a substantially continuous anti-glare module system along the divided highway.

7. The system in claim 6, wherein the mounting rods are mounted into the tubular members with the use of mounting pins.

8. The system in claim 6, wherein each of the anti-glare modules may be slideably removed from the mounting rods in the event of an emergency or damage to the anti-glare module body.

9. The system in claim 6, wherein the anti-glare modules further comprise means for impeding access between a first section of the divided highway and a second section of the divided highway.

* * * * *